United States Patent [19]

Idland

[11] Patent Number: 4,614,070

[45] Date of Patent: Sep. 30, 1986

[54] SUPPORT SHOE

[76] Inventor: Kristoffer Idland, Lerkeveien 15, N-4300 Sandnes, Norway

[21] Appl. No.: 576,737

[22] Filed: Feb. 3, 1984

[30] Foreign Application Priority Data

Nov. 7, 1983 [NO] Norway ..... 834046

[51] Int. Cl.[4] ..... E02D 27/42

[52] U.S. Cl. ..... 52/296; 52/295; 52/370; 52/713

[58] Field of Search ..... 52/295, 296, 370, 713

[56] References Cited

U.S. PATENT DOCUMENTS

| | | | |
|---|---|---|---|
| 967,107 | 8/1910 | Cook et al. | 52/295 |
| 1,696,288 | 12/1928 | Underwood | 52/296 |
| 2,227,713 | 1/1941 | Higgins | 52/370 X |
| 3,921,356 | 11/1975 | Hughes | 52/370 X |
| 4,412,407 | 11/1983 | Melfi et al. | 52/705 X |

*Primary Examiner*—Alfred C. Perham

*Attorney, Agent, or Firm*—Schwartz, Jeffery, Schwaab, Mack, Blumenthal & Evans

[57] ABSTRACT

A support shoe for a pole or post, comprising an anchor member (1) in the form of a rod for embedding in a vertical position in a concrete foundation, and a fork-shaped holder (2, 4) for retaining the lower end of a post or pole that can be screwed or nailed to the holder's two vertical support plates (4). Each of the vertical support plates (4) is formed with a horizontal guide and fastening member (4*a*) disposed at a right angle thereto. Utilizing said guide members (4*a*), the vertical support plates are adapted to be movable and securable in relation to each other, for varying the fork width according to the dimension of the pole.

To ensure a maximum range of adjustment for the vertical support plates (4) of the fork holder and at the same time to permit readjustment of the support plates (after concreting) for orienting their planes in a specific direction, a base plate that is part of the support shoe construction is formed with two parallel guides (9), one for each of the two horizontal guide portions of the angular support plates, and the holder (2,3,4) and said anchor rod (1,1*a*) are detachably connected to each other via a screw connection (1*a*,3*a*).

2 Claims, 3 Drawing Figures

SUPPORT SHOE

BACKGROUND OF THE INVENTION

1. Field of the Invention

The present invention relates to a novel embodiment of a support shoe for a post or pole, comprising an anchor rod and a fork-shaped holder/fastener member.

2. Background Art

Such support shoes or post supports are used for supporting vertical wooden poles of different dimensions and embodiments. The poles normally vary from 90 to 178 mm in cross section, with 16 different dimensions within this range.

One conventional support shoe comprises a vertical anchor bolt that is intended to be embedded in the concrete foundation for the pole, with an associated upwardly directed holder/fastener member disposed at ground level. This is known as a fixed support shoe, wherein the anchor bolt is fixedly attached to the holder member. The holder has a fixed fork width, and almost no wooden pole dimension will fit exactly in the support shoe. In addition to the fact that a fixed support shoe of this type must be made in a relatively large number of different sizes, and even so has a poor fit to the various pole dimensions because the fork width is not adjustable, this support shoe requires such high precision during mounting that the procedure is unreasonably time consuming. The fork-like support plates on the holder may become incorrectly oriented during concreting because the anchor bolt to which they are fixed could turn about its own axis into an incorrect position. If this happens, it cannot later be corrected.

The support shoe disclosed in unpublished Danish Patent Application No. 4482/81 also suffers from the same drawback. In this embodiment, the anchoring pin is fixed to one of the holder's angle plates, which forms one-half of the fork-like holder. During use, one leg of the angle plate is essentially horizontal, while the other leg is essentially vertical to support the pole or post. The corresponding horizontal leg of the other angle plate is movably disposed on top of the horizontal leg of the first angle plate, so that the respective vertical legs of the fork-shaped holder, which are formed by the other two legs on the respective angle members, can be moved toward and away from each other for varying the fork width of the holder. The range of adjustment for a holder member of this type, wherein a horizontal leg of one angle plate slides on the horizontal leg of the other angle plate, and wherein said horizontal legs of the angle plates are formed with mutually engaging guidance and locking means, is very limited. The minimum fork width corresponds to the length of said plate-shaped, horizontal leg of the angle member (when the angle members have been pushed together as far as possible), while the maximum width of the fork is limited by the degree of overlap that is required to ensure that the cooperating guidance and locking means on the respective horizontal legs remain in engagement.

SUMMARY OF THE INVENTION

The object of the present invention is to provide an improved support shoe wherein the above drawbacks are eliminated, and which exhibits other advantages as well in relation to the prior art.

This is obtained in accordance with the invention with a support shoe having a base plate with two parallel guides formed in the upper face thereof. The guides receive vertical support plates to which a pole is secured.

By forming the base plate of the holder member with two parallel guide grooves, one for each of the horizontal legs of the respective angle plate support members, each angular support plate obtains a wider range of adjustment alone than both would have had together in a joint guide groove of the same length. The fact that the vertical supports thereby will not be disposed diametrically opposite each other, as in the case of the prior art fork holders, but will be offset (parallel displacement) in relation to each other, has surprisingly proved to give a stronger grip about columns, poles and the like, in that the vertical supports are disposed diagonally facing each other.

A screw connection between the anchor rod and the holder portion of the support shoe makes it possible, inter alia, to orient the vertical supports in the correct position independently of how the anchor rod may have been turned abouts its own axis during casting of the concrete foundation. The detachable connection between the anchor rod, which is preferably formed by deformed high yield rod that has very good adhesion to concrete, and the holder portion of the shoe, is also advantageous for packing, transportation, etc. of the assembly.

Other advantageous structural features are recited in the dependent claims 2–4.

A practical procedure to follow during casting of the support shoe in concrete is as follows: The upper, threaded portion of the anchor rod is placed within a block of isopor or plastic having two opposing, parallel, flat sides, wherein one flat side is placed on the surface of the unhardened concrete into which the rod penetrates. The block thus functions partly as a formwork member and partly as protection for the threads on the rod during the concreting operation.

BRIEF DESCRIPTION OF THE DRAWINGS

The invention will be described in greater detail in the following with reference to an exemplary embodiment of the support shoe, as illustrated in the accompanying drawings, which show the support shoe in perspective from three different angles.

DETAILED DESCRIPTION OF THE INVENTION

Figure 1:
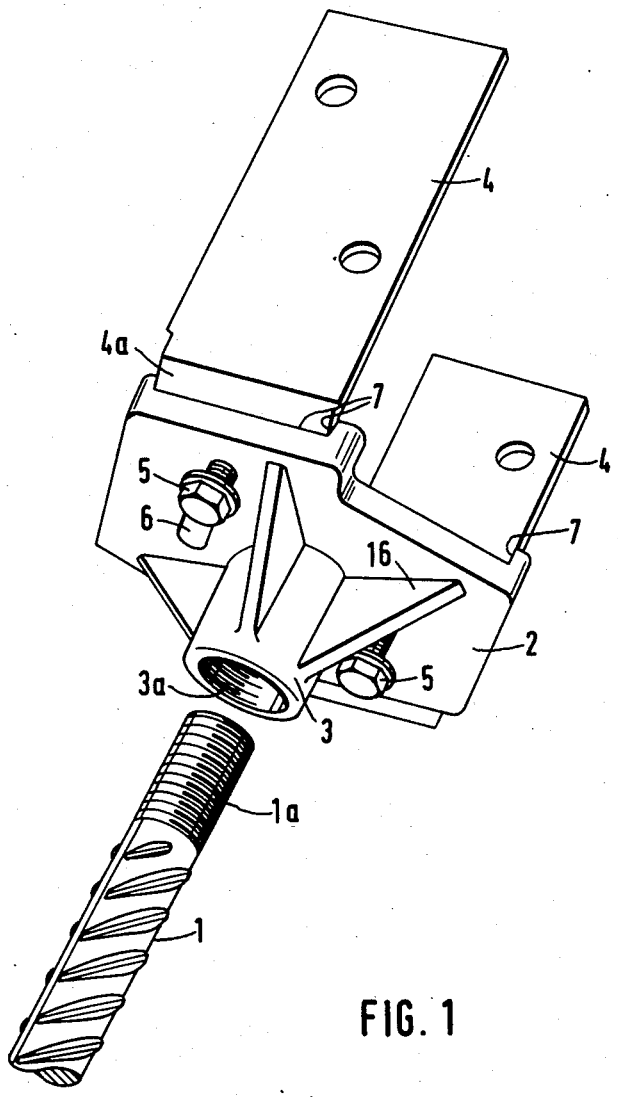
FIG. 1 shows the support shoe at an angle from the bottom prior to screwing together the anchor rod and the holder, with the opposing support plates shoved in so that they are almost flush with the adjacent edge of the base plate.

In the following, the terms "vertical" and "horizontal" refer to the orientation of the members when the support shoe has been concreted and is in position for use.

The support shoe shown in the drawings comprises two main parts, an anchor member made of deformed high yield rod 1 (ridged reinforcing rods with good adhesion to concrete), and a fork-shaped holder/fastener member, formed by a base plate 2 with a threaded coupling socket 3 extending from the bottom face thereof and two right-angle support plates 4, 4*a*. The vertical legs 4 of the support plates, which are provided with holes for nails or screws, are intended to lie against two parallel sides of a vertical wooden pole, which is fastened to the plates 4 by means of nails or screws.

The anchor rod 1 is formed with an upper threaded end portion 1*a* which, after the rod has been embedded in concrete, is brought into engagement with the internally threaded coupling socket 3, whose bore is indicated by reference numeral 3*a*. On the exterior, the socket is provided with stiffening and reinforcing ribs 16, extending radially from the socket 3 to the bottom face of the base plate 2 and tapering in height toward the base plate.

Figure 2:
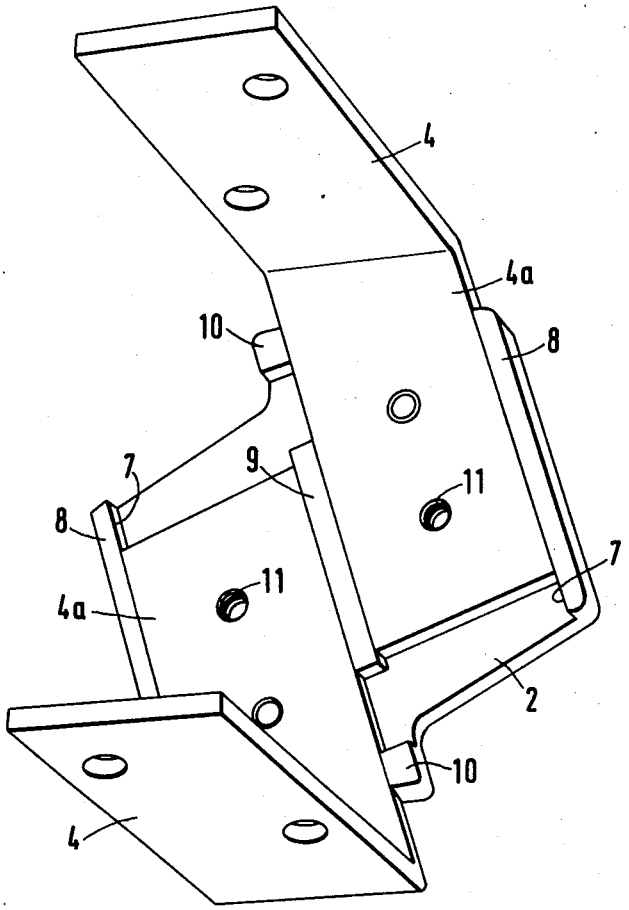
FIG. 2 shows the support shoe seen at an angle from above with the support plates drawn further apart than in FIG. 1.

As seen especially clearly in FIG. 2, the upper face of the base plate 2 is formed with two parallel guide grooves 7, formed between upstanding edge flanges 8 at two opposing margins of the base plate and upstanding wall portions 9,10 at the center of the plate between the edge flanges, said wall members 8,9,10 being mutually parallel and extending upwardly to the same height, which corresponds to the thickness of material of the angular support plates 4,4*a*. The width of each of the guide grooves 7 corresponds to the width of the angular support plates 4,4*a*.

Figure 3:
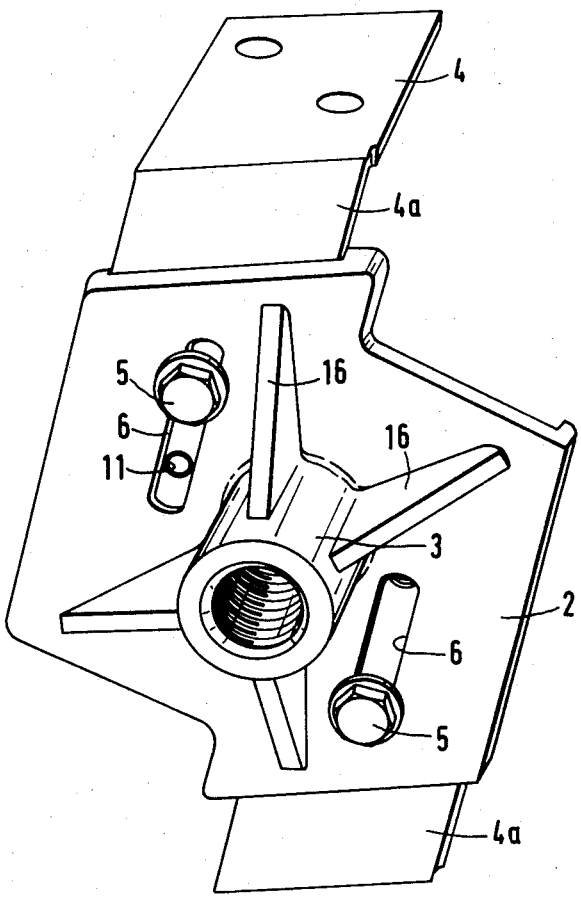
FIG. 3 shows the support shoe as seen from the bottom as in FIG. 1, but at less of an angle, with the support plates drawn further apart from each other than in FIG. 1. The anchor rod is not shown in this drawing.

The horizontal leg 4*a* of each support plate is provided with holes 11 for a guide bolt 5 (see in particular FIG. 3), which slides in a slot 6 formed in the base plate 2.

It may easily be seen that the variable adjustment means formed by the guide grooves 7, the slots 6, the bolts 5 and the holes 11, provides an extensive range of adjustment possibilities for the support plates 4,4*a*, so that the distance between the vertical legs of the support plates, or the width of the fork, can be adapted to a large number of different pole dimensions.

When the anchor rod 1 is to be embedded in the concrete foundation, its upper threaded end portion is covered by a block of isopor or plastic, for example, or by a similar material with low density and having two parallel, horizontal surfaces, one of which is laid against the concrete surface, while the opposite, upper horizontal surface is provided with a mark showing the rod's longitudinal axis, facilitating correct orientation of the rod and therefore correct placement of the support shoe. The block thus functions as a formwork member, while at the same time it protects the threads 1*a* on the reinforcing rod 1.

When the concrete has hardened, the holder part 2–4 is screwed onto the end of the rod 1*a* by means of the coupling socket 3.

The screw connection, in addition to enabling readjustment of the variable width between the support plates 4, also permits a degree of height regulation.

I claim:

1. A support shoe for supporting an elongated object comprising a longitudinal anchor member in the form of a rod adapted to be embedded in a foundation in a substantially vertical position by being cast in a concrete foundation, and a fork-shaped holder/retainer member adapted to grip the object from two opposite side faces thereof, wherein a bottom end surface of the object is adapted to rest on a substantially horizontal section between vertical support plates of said fork-shaped holder/retainer member, the object being retained between said vertical support plates, and wherein said vertical support plates each has a horizontal guide and fastener part disposed at a right angle relative to each vertical plate, said horizontal guide and fastener parts being adapted to be movable in relation to each other to permit adjustment of the width of said fork-shaped holder/retainer member in order to fit the dimensions of the object, and to be retained at an adjusted width, said support shoe further comprising:

a base plate having two parallel guides formed in an upper surface thereof, one for each of said horizontal guide and fastener parts of said vertical support plates, said fork-shaped holder/retainer member and said anchor member being detachably connected to each other; and wherein two opposing edges of said base plate and a section disposed centrally between said edges are provided with upright wall sections disposed at a right angle relative to said base plate and of substantially the same height as the thickness of material of said horizontal guide and fastener parts, said upright wall sections being mutually parallel and spaced apart a distance corresponding to the width of each horizontal guide and fastener part.

2. A support shoe according to claim 1, wherein said anchor member and said fork-shaped holder/retainer member are detachably connected by a screw connection.

* * * * *